US005526456A

United States Patent [19]

Heinz

[11] Patent Number: 5,526,456

[45] Date of Patent: Jun. 11, 1996

[54] MULTIPLE-DRIVER SINGLE HORN LOUD SPEAKER

[75] Inventor: Ralph D. Heinz, Corona, Calif.

[73] Assignee: Renku-Heinz, Inc., Irvine, Calif.

[21] Appl. No.: 380,337

[22] Filed: Jan. 30, 1995

Related U.S. Application Data

[63] Continuation of Ser. No. 22,967, Feb. 25, 1993, abandoned.

[51] Int. Cl.[6] ..... H04R 25/00

[52] U.S. Cl. ..... 381/156; 381/182; 181/152

[58] Field of Search ..... 381/156, 182, 381/186, 188, 89, 88, 90, 205, 24; 181/152, 159, 144, 145, 147, 163, 187, 188, 199

[56] References Cited

U.S. PATENT DOCUMENTS

| | | | |
|---|---|---|---|
| 1,674,683 | 6/1928 | Hahnemann . | |
| 1,767,358 | 6/1930 | Gottshall . | |
| 1,907,723 | 5/1933 | Bostwick . | |
| 1,992,300 | 2/1935 | Fanger . | |
| 2,107,757 | 2/1938 | Kinsley . | |
| 2,269,284 | 1/1942 | Olson . | |
| 2,638,510 | 5/1953 | Brami . | |
| 3,065,816 | 11/1962 | Ranger | 181/147 |
| 3,898,384 | 8/1975 | Goekel | 181/152 |
| 4,174,019 | 11/1979 | Krammer | 181/159 |
| 4,227,051 | 10/1980 | Thomas et al. | 181/146 |
| 4,256,930 | 3/1981 | Garner et al. . | |
| 4,469,921 | 9/1984 | Kinoshita | 381/156 |
| 4,524,846 | 11/1985 | Whitby | 181/159 |
| 4,619,342 | 10/1986 | Buck . | |
| 4,836,327 | 6/1989 | Andrews et al. . | |
| 4,845,759 | 7/1989 | Danley | 381/156 |
| 4,885,782 | 12/1989 | Eberbach | 381/89 |
| 4,969,196 | 11/1990 | Nakamura . | |
| 5,004,067 | 4/1991 | Patronis . | |
| 5,046,581 | 9/1991 | Mitchell . | |
| 5,109,423 | 4/1992 | Jacobson et al. . | |

FOREIGN PATENT DOCUMENTS

| | | | |
|---|---|---|---|
| 0033517 | 3/1977 | Japan | 381/97 |
| 303837 | 1/1929 | United Kingdom . | |
| 723604 | 2/1955 | United Kingdom . | |

OTHER PUBLICATIONS

Brochure entitled "Broad Bandwidth . . . Controlled Directivity" by Frazier, undated.

Brochure entitled "Pro–Ax Series Model PX–1090" by OAP Audio, undated.

*Primary Examiner*—Curtis Kuntz
*Assistant Examiner*—Huyen D. Le
*Attorney, Agent, or Firm*—Knobbe, Martens, Olson & Bear

[57] ABSTRACT

A multiple-driver, single horn loudspeaker is disclosed. The loudspeaker comprises an enclosure having a centerline and a single horn mounted therein. The horn has a throat located in the enclosure, and a mouth which is located at an open end of the enclosure. At least one high frequency driver is used to produce high frequency sound which is directed through a passage located along the centerline and are coupled to the throat of the horn. Low frequency drivers for producing low frequency sounds are either located on either side of the centerline and are also coupled to the throat of the horn, or a single low frequency driver is located along the centerline and connected to the throat of the horn. The single horn acts as a waveguide for the sound produced by both the low and high frequency drivers.

24 Claims, 5 Drawing Sheets

FIG. 2 (PRIOR ART)
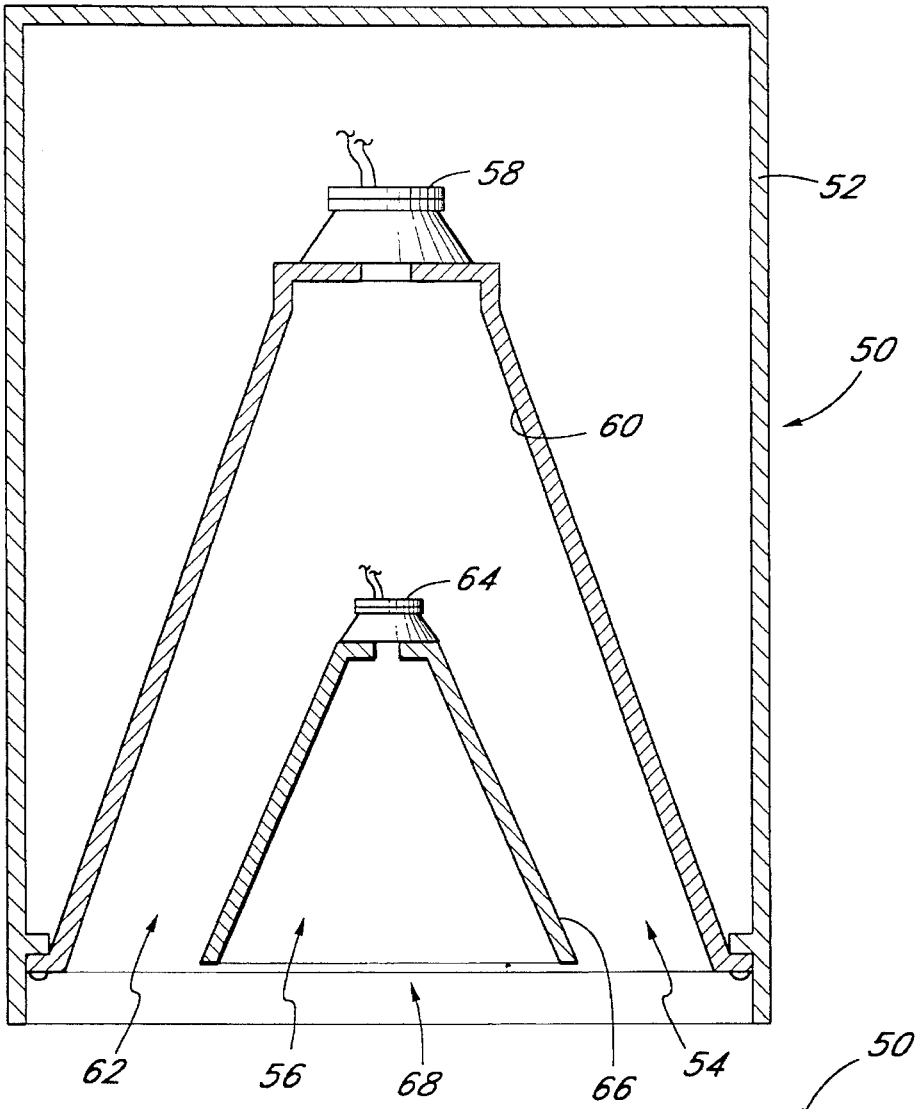
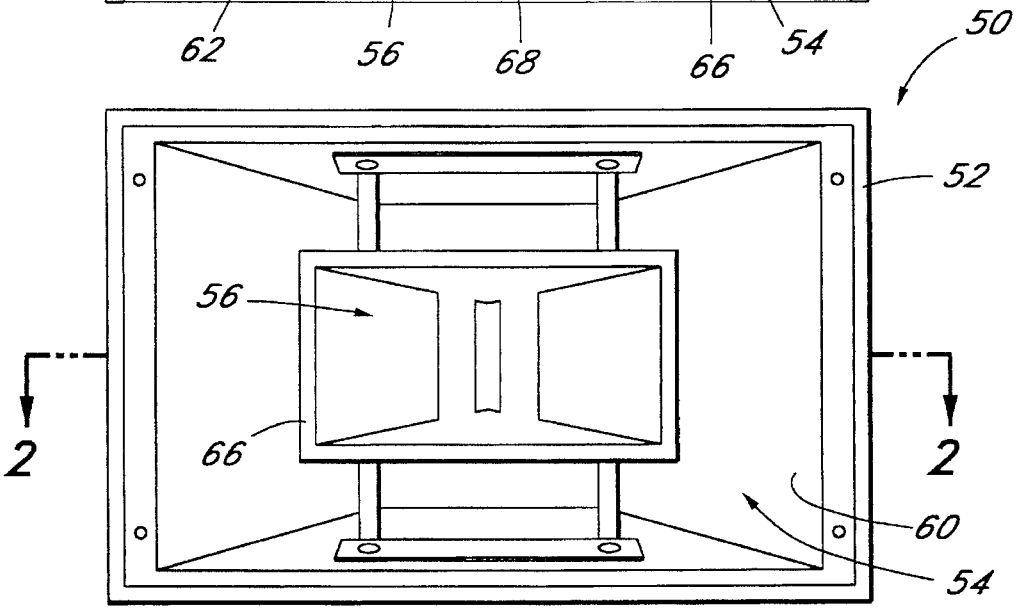
FIG. 1 (PRIOR ART)

FIG. 4
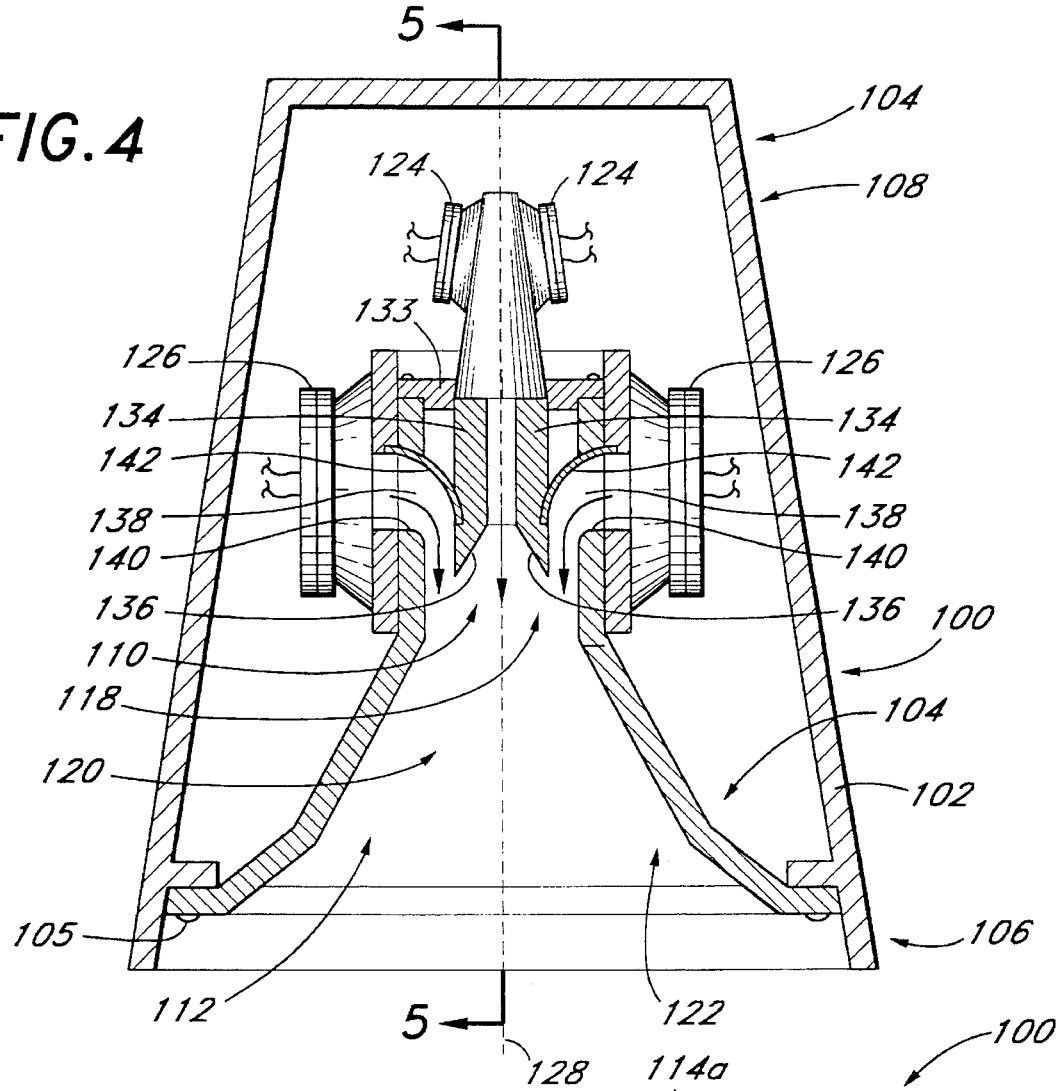
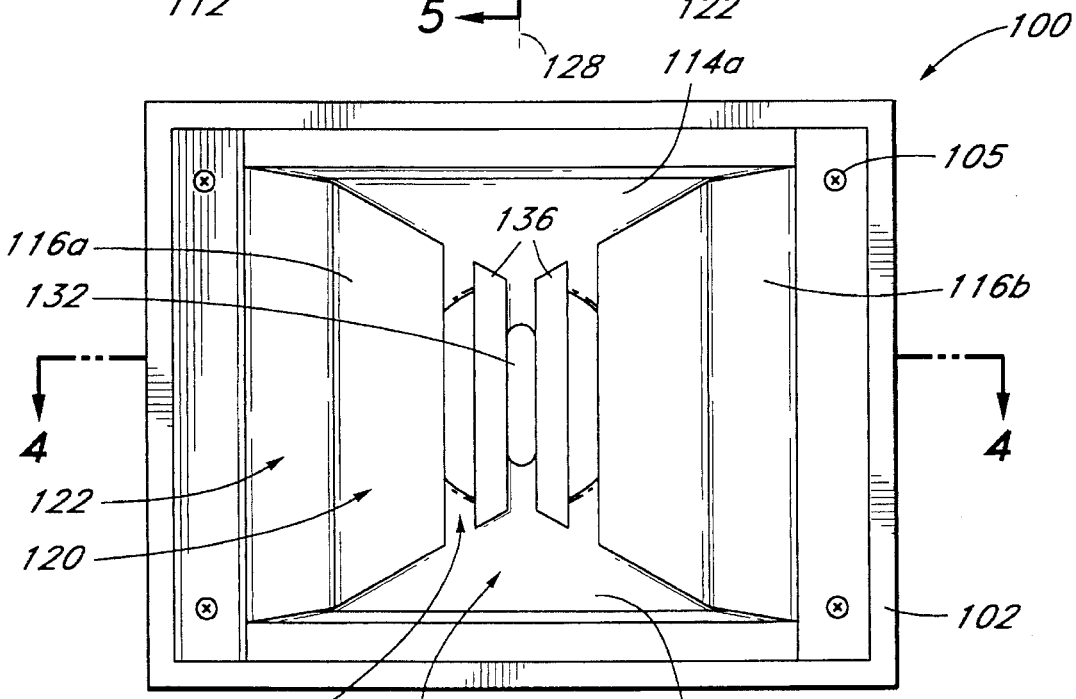
FIG. 3

MULTIPLE-DRIVER SINGLE HORN LOUD SPEAKER

This application is a continuation of application Ser. No. 08/022,967, filed Feb. 25, 1993, abandoned.

FIELD OF THE INVENTION

The present invention relates to a horn type loudspeaker. More specifically, the present invention relates to a loudspeaker employing low and high frequency sound generating drivers which utilize a common horn to direct the sound to a listener.

BACKGROUND OF THE INVENTION

Currently, loudspeaker systems commonly utilize a multispeaker approach in which two, three, four or more speakers are used in a single loudspeaker or system. These systems have been developed in order to provide a sound producing device which accurately and efficiently produces different types of sounds having a wide range of frequencies. For example, such multispeaker arrangements have been developed in order that such systems or loudspeakers produce voice or speech and music equally well.

These systems often include one or more of a variety of horn and/or diaphragm speakers torn and diaphragm type speakers both utilize a driver connected to a diaphragm. The horn type speaker further includes a horn or waveguide connected to the diaphragm, however, for transmitting the sound generated by the diaphragm. The waveguide normally comprises a throat and a mouth connected by a passage. In the horn type device, the diaphragm is located at the throat of the waveguide, and the passage directs the acoustic energy to the open end or mouth of the horn where it emanates to the listener.

In designing loudspeaker systems utilizing horn or diaphragm only type speakers, a number of goals are important. First, it is desirable that the loudspeaker efficiently produce the sound, requiring as little power as possible. Second, it is desirable that the speaker be as compact as possible for its intended use, without otherwise sacrificing sound reproduction characteristics. Third, the speaker should produce and emanate sound directly to the listener, i.e., the sound waves generated by the speaker should not be blocked or interfered with by the speaker itself as the sound waves leave the speaker and radiate towards the listener. Fourth, it is desired that when using multiple radiating devices together, that all the sounds leaving the devices are in phase. Lastly, the speaker should exhibit good directivity characteristics. Directivity in the speaker context refers to the ability or the speaker to emit waves which are concentrated. The result of good directivity is the ability of the listener to discern the direction from which the sound is emanating because sounds from other directions are attenuated. In large enclosed spaces, such as large rooms, increased directivity means that the amount of direct sound, as opposed to reflected sound, which reaches the listener is increased. In horns, directivity is directly related to the geometrical shape of the waveguide.

Prior to this time, there have been many attempts at designing a loudspeaker which has each of the desired characteristics. Each of these designs, however, suffers a problem which, before the invention later described, has not been solved.

First, a number of loudspeakers have been designed which utilize a horn-in-horn approach. These speakers were designed primarily in an attempt to reduce the size of the bulky multispeaker systems described above. In this type of loudspeaker, a large horn is designed to produce lower frequency sounds. Normally, a low frequency driver is connected to this large horn, with the waveguide directing the sound from the driver to a mouth located at the front of the enclosure. A smaller horn designed to produce higher frequency sounds is located within the waveguide of the larger horn. This horn utilizes a high frequency driver connected to a waveguide which is much smaller than that of the larger horn. The high horn waveguide is normally mounted to the walls of the waveguide walls of the low horn, near the mouth of the waveguide, utilizing some type of bracket.

The horn-in-horn design suffers, however, from numerous drawbacks. First, the placement of the small horn directly in the waveguide of the large horn creates an acoustic shadow. This shadow represents low frequency sound waves which are blocked as they emanate from the large horn by the small horn which is located in the low horn waveguide. Further, the placement of the drivers of the small horn in front of the drivers of the large horn means that the sounds from these two horns are produced in two different locations. As the sound leaves the speaker, the high frequency sounds and low frequency sounds are thus out of phase because of the distance between their source points. In order for the sound to accurately be reproduced, an appropriate signal delay or other circuit must be added in order to delay the electrical signal routed to the high horn, in order that the sound from the small horn be delayed such that the sound which leaves the loudspeaker is in phase.

This loudspeaker design also suffers from a directivity problem. As stated above, waveguide geometry affects the directivity or sound coverage of the sound leaving the horn. However, at a given frequency, a corresponding waveguide shape is necessary to maximize directivity. Because each horn produces sound over a wide bandwidth, the waveguide for each horn is normally designed to maximize directivity with respect to sound in the entire bandwidth. Therefore, the horn geometry is usually chosen so directivity is maximized for sound in the middle of the bandwidth, with the directivity for sounds having frequencies on either end of the bandwidth being less than optimum. The largest loss in directivity, however, occurs at the cross-over point between the two horns. At this point, sounds having frequencies only a few Hertz apart are produced by horns having very different geometries. This means that essentially the same sounds are created by horns which act very differently upon the acoustical waves. Therefore, the directivity at these crossover points is compromised. In multiple horn loudspeaker systems, especially those in which the cross-over frequency is in the vocal band, the loss in directivity causes the sound coverage to change dramatically over this frequency region.

Several loudspeaker designs have attempted to improve upon the above design. One such system is described in U.S. Pat. No. 5,046,581. This patent describes a horn-in-horn loudspeaker system in which the drivers of the small horn are located the same distance from the mouth of the small horn as the low drivers are from the mouth of the large horn. This is accomplished by having the drivers of the small horn connected to an extremely long passage which leads to the small horn waveguide. This design thus eliminates the phase problem and eliminates the need for expensive signal delay circuits. This design, however, still suffers from shadowing and directivity problems.

Several loudspeakers have also utilized a horn for producing high frequency sound located inside of the diaphragm of a low frequency producing speaker. One such design is described in U.S. Pat. No. 2,269,284. This patent generally describes a loudspeaker in which the driver of the horn and the diaphragm speaker are concentric, thus eliminating phase problems. This design, however, still has severe directivity problems. While the walls of the horn and diaphragm are essentially one and the same, thus limiting directivity problems at the cross-over frequency in the abstract, several other problems are created. First, the shape of the diaphragm is not well suited for use as a waveguide, meaning that overall directivity is lost for sounds created by the horn. This loss cannot be fixed by altering the shape of the diaphragm either, for once the diaphragm is so altered, it no longer functions to produce the low frequency sounds. Further, because the diaphragm is not well suited for use as a waveguide, part of the efficiencies normally gained through use of the horn are lost.

Lastly, U.K. Patent No. 303,837 describes a loudspeaker utilizing two horns whose sound channels merge to form a single outlet. This design eliminates shadowing and phase problems, but suffers from several other disadvantages. First, this design is a line array type arrangement, thus causing the sound from each single driver to remain a separate source. Second, this arrangement of the sound channels does not permit the sound from both sources to be coincident in both the horizontal and vertical plane. Thus, true point source performance is not achieved. Lastly, the throat size at the merger of the sound channels cannot be simultaneously large enough to allow passage of the low frequency sound without coloration, and yet at the same time be small enough to allow proper diffraction of the highest frequencies.

SUMMARY OF THE INVENTION

In order to overcome the above stated problems and limitations, there is provided a multiple-driver single horn loudspeaker.

In particular, there is provided a loudspeaker comprising an enclosure in which low and high frequency drivers connected to a single horn are mounted. The horn has a mouth which opens at one end of the enclosure. The drivers are connected to a throat end of the horn located within the enclosure.

Preferably, a pair of low frequency and a pair of high frequency drivers are mounted about a centerline of the horn. The high frequency drivers are mounted equidistantly on either side of the centerline and are connected to the throat of the horn via a coupling passage which lies along the centerline. This passage is preferably of a width less than the length of the shortest wavelength of sound produced by the high frequency drivers, and preferably opens at the same angle as the horn. Each low frequency driver is preferably mounted equidistantly on either side of the centerline in front of the high frequency drivers, and is connected to the horn by a coupling passage which leads from the driver to the throat.

Walls of the horn direct the sound to the listening area and define the coverage pattern of the horn. The compound throat described above is compatible with horns of any desirable coverage pattern. Preferably, the horn comprises top and bottom and side walls. The top wall preferably opens above the horizontal at an angle of 20 degrees, and the bottom wall preferably opens at an angle of 20 degrees below the horizontal. The sides of the horn are preferably parallel in the throat section, opening to 60-degree and 104-degree sections until they form the mouth.

In a second embodiment, units of high and low frequency drivers are stacked upon one another in the throat of a single horn, thereby increasing the power handling and sound generating capabilities of the loudspeaker.

Lastly, in a third embodiment, a single high and low frequency driver are mounted along a centerline of a loudspeaker. Both of these drivers are connected to the throat of a single horn in a fashion similar to that described above.

Importantly, the loudspeaker (all three embodiments) of the present invention utilizes multiple drivers and a single horn. The high frequency sound produced by the high frequency drivers is routed through the coupling passage to the throat of the horn, thus creating an apparent source of sound located along the centerline of the horn in the throat of the horn. The low frequency sound is routed to the throat of the horn and has an apparent source at the same point as the high frequency sound. In the first and second embodiments, this is because of the coaxial design of the speakers. In the third embodiment, this is because the low frequency driver is mounted along the centerline.

The use the common horn causes the apparent source of the high and low frequency sound to be coincident in both the horizontal and vertical planes since the single horn acts as the waveguide for all sound produced. Further, the use of the single horn eliminates shadowing problems. The length of the coupling passages is chosen such that phase problems are eliminated and no time delay circuits are needed.

Lastly, in the present invention, sound directivity is maximized. Because a single horn is used to direct the high and low frequency sounds, there is no directivity loss at cross-over points because of horn geometry change. Further, the shape of the horn is specifically designed to maximize directivity over the entire bandwidth of sounds produced.

These and other aspects of the invention will become apparent from a study of the following description in which reference is directed to the following drawings.

DESCRIPTION OF THE DRAWINGS

FIG. 1 is a front view of a prior art horn-in-horn loudspeaker.

FIG. 2 is a cut-away view of the loudspeaker of FIG. 1, taken along line 2—2.

FIG. 3 is a front view of the loudspeaker of the present invention.

FIG. 4 is a cut-away top view of the loudspeaker of FIG. 3 taken along line 4—4.

Figure 5:
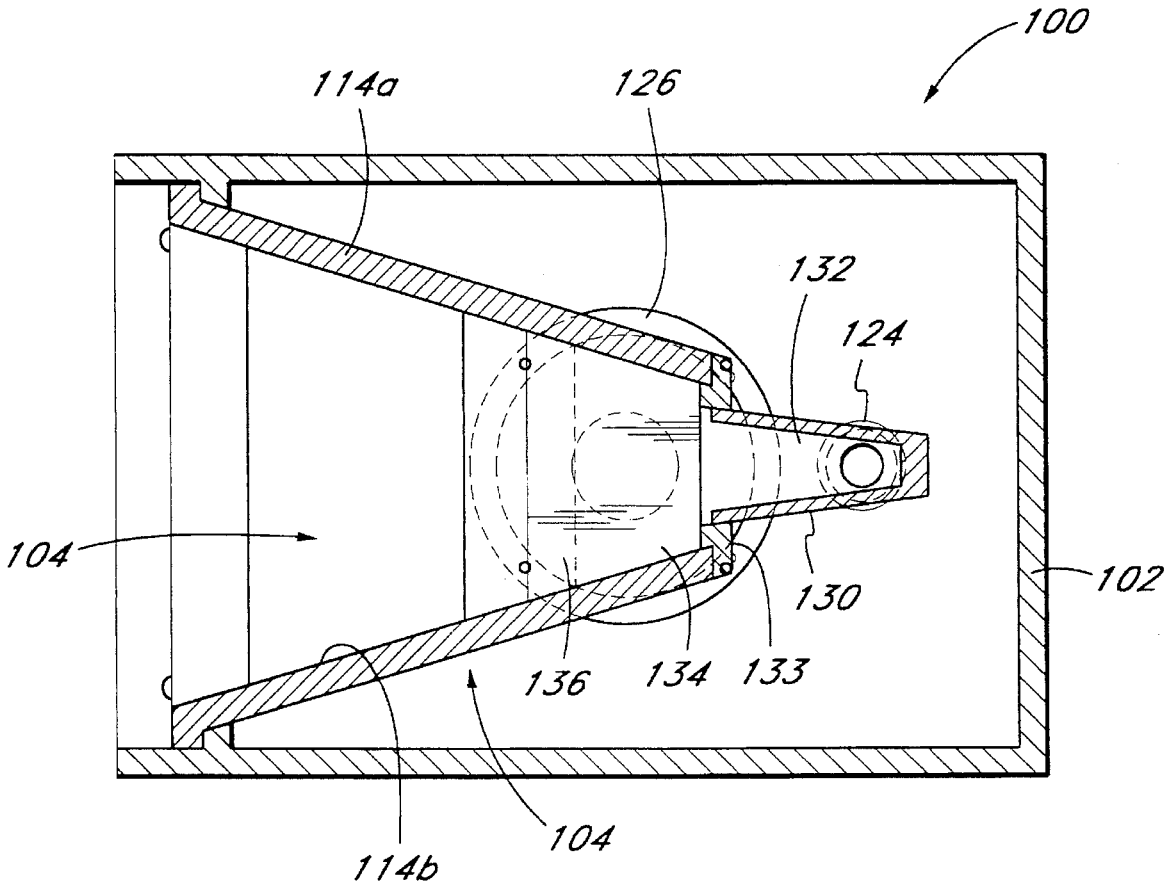
FIG. 5 is a side view of the loudspeaker of FIG. 4 taken along line 5—5.

DETAILED DESCRIPTION OF THE PREFERRED EMBODIMENT AND DESCRIPTION OF THE PRIOR ART

FIGS. 1 and 2 illustrate a loudspeaker 50 of the prior art which utilizes the horn-in-horn approach. As can be seen, the prior art loudspeaker 50 comprises an enclosure 52, a large horn 54 and a small horn 56. The large horn 54 is mounted within the enclosure 52 and comprises a driver 58 connected to a waveguide 60 which has a mouth 62 which opens at one end of the enclosure 52. The small horn 56 is mounted within the waveguide 60 of the large horn 54. The small horn 56 comprises a driver 64 and a waveguide 66 connected thereto which has a mouth 68 located near the mouth 62 of the large horn 54.

In comparison to the prior art loudspeaker, FIG. 3 illustrates a multiple-driver, single horn loudspeaker 100 of the present invention. In general, this loudspeaker 100 comprises an enclosure 102 having a single horn 104 located therein. As best seen in FIG. 4, the enclosure 102 is preferably generally trapezoidal in shape, having an open wide front end 106 and a narrow rear end 108, in order that the design be space efficient. The enclosure 102 may be made of any material; however, it is desired that the enclosure 102 be made of wood or a similar substance. It is noted that the loudspeaker 100 of the present invention need not include an enclosure, in which case the horn 104 may be directly mounted to a wall or other similar structure.

As best illustrated in FIGS. 3 and 4, the horn 104 has a throat area 110 and a mouth 112. The mouth 112 is located at the front end 106 of the enclosure 102, allowing sounds to emanate from the loudspeaker 100 to the listener.

The horn 104 is defined by top and bottom walls 114*a,b* and side walls 116*a,b*. As stated earlier, the specific geometry of the waveguide or horn 104 is very important as it relates to the sound coverage a horn can provide. The following dimensions and parameters for the horn 104 are preferred; however, many other horn geometries are acceptable, the specific geometry depending upon the particular speaker characteristics desired. Preferably, the distance from the throat 110 to the mouth 112 of the horn 104 is about 10 inches. It is desired that the top wall 114*a* extend from the throat 110 to the mouth 112 at a 20-degree angle above a horizontal plane, and that the bottom wall 114*b* do the same, but at a 20-degree angle below the horizontal plane.

Preferably, the side walls 116*a,b* form a first section 118 at the throat 110 in which the walls 116*a,b* are parallel and separated by a distance of about 4.5 inches. From this section 118, the walls 116*a,b* extend about 3 inches to a second section 120 in which the walls 116*a,b* open at a 60-degree angle with respect to one another. The walls 116*a,b* in this portion 120 of the horn 104 extend approximately 5 inches towards the mouth 112. Next, the walls 116*a,b* open into a third section 122 in which the walls 116*a,b* are set at a 104-degree angle with respect to one another. The walls 116*a,b* preferably extend a distance of about 2 inches towards the mouth 112 in this section 122. Lastly, at the front of the enclosure 102, the walls 116*a,b* assume a position perpendicular to a centerline 128 of the enclosure 102, thus forming the mouth 112 of the horn 104.

As stated above, the listed dimensions and parameters may, of course, be changed depending upon the specific sound coverage desired. For example, the horn 104 may open at a 90-degree angle in the horizontal plane and a 60-degree angle in the vertical plane.

The horn 104 may be made of wood or any other substance which is rigid and does not absorb acoustical energy. The horn 104, as illustrated, may be attached Lo the enclosure 102 through the use of screws 105.

As illustrated in FIGS. 4 & 5, two drivers 124 preferably are connected to the horn 104 for producing high frequency sounds, and two drivers 126 are preferably connected to the horn 104 for producing low frequency sounds. It is not important exactly what bandwidth of sounds are produced by each set of drivers 124, 126. It is preferable, however, that the high frequency drivers 124 be of a type which produce sound over a bandwidth of 1 kHz to 20 kHz, while the low frequency drivers 126 produce sound over a range of 200 Hz to 3 kHz. Thus, the high frequency drivers 124 are preferably 1-inch compression drivers, such as that manufactured by Renkus-Heinz, Inc. of Irvine, Calif., Model No. SSD 1800. The low frequency drivers 126 are preferably 6.5-inch compression drivers, such as that manufactured by R.C.f. of Italy, Model No. L6L380. As can be seen, such an arrangement does not account for the production of sounds below the 200 Hz frequency. These sounds may, however, be accounted for by a third separate loudspeaker or similar arrangement such as that where the third horn is mounted directly below the loudspeaker 100 of the present invention, or by appropriate selection of the low frequency driver.

As can be seen, the drivers of each set of drivers 124, 126 are mounted on either side of the centerline 128 of the enclosure 102. Each driver 124, 126 is connected to the throat 110 of the horn 104. As best illustrated in FIGS. 4 and 5, the high frequency drivers 124 are mounted in a coupling member 130 which has an oval shaped coupling passage 132 therein. The passage 132 formed in the member 130 is preferably 3.4 inches tall and about 1 inch wide. The coupling member 130 is preferably an acoustic coupler capable of phase summation of the sounds produced by the drivers 124 over the sound frequency range of the drivers 124. A preferred coupling member 130 is a Powerfold coupler manufactured by Renkus-Heinz of Irvine, Calif. The coupling member 130 is connected to two walls 134 located partially within the throat 110 of the horn 10 such a connection may be facilitated with a support member 133 located above and below the coupling member 130.

The walls 134 may be formed as part of the horn 104, or alternatively formed separately and installed in the horn 104. These walls 134 are preferably separated by a distance of 1 inch. The walls 134 form an aperture through which the high frequency sound emanates into the horn 104. It is preferable that the aperture be small in relation to the wavelength of the sound being transmitted. A 1-inch aperture has been found desirable for use with drivers 124 having the above listed characteristics. However, if the drivers 124 have a different sound reproduction bandwidth, the aperture size should correspondingly be adjusted through placement of the walls 134.

At a point even with the throat 110 of the horn 102, the walls 134 each have a tapered portion 136, which tapered portion 136 causes the surfaces of the walls 134 to be 60 degrees apart, thus having the same angle as the walls 116*a,b* at portion 120 of the horn 104. The inner surfaces of the walls 134 are preferably aligned with the surfaces of the portion 120 of the walls 116*a,b*.

It is further noted that while the use of two high frequency drivers 124 is preferred, one driver may be used. The use of two drivers 124 increases the power handling capacity (and thus sound generating capability) of the loudspeaker 100. However, the use of one driver 124 is acceptable, as in either case, if the sound produced by the high frequency driver or drivers 124 is directed uniformly through passage 132.

Likewise, the low frequency drivers 126 are mounted equidistantly on either side of the centerline 128 of the loudspeaker 100. As illustrated, the low frequency drivers 126 are also connected to the throat 110 of horn 104. As illustrated, these drivers 126 are connected to passages 138 formed by a curved end 140 of the throat 110 of the horn 104 and a curved member 142. Each curved member 142 is preferably connected to the wall 134 and to the driver 126.

As designed, it is preferred that each passage 138 be about as wide as the aperture formed for the high frequency sounds. It is also preferred that these passages 138 be of a length such that the distance between the high frequency drivers 124 and the throat 110, and the low frequency drivers 126 and the throat 110, be substantially the same in order to eliminate phase problems.

Because of the mass of the high and low frequency drivers 124, 126, a mounting bracket or brace (not shown) may be used to support the drivers 124, 126 and related members with respect to the enclosure 102.

The function of the components of the loudspeaker 100 will now be described along with the operation of the loudspeaker 100 of the present invention with reference to FIGS. 3–5 and the above description.

The loudspeaker 100 (or normally a pair thereof) is first connected to an amplifier or other system well known in the art for providing the electrical signals which are necessary to power the drivers 124, 126 of the loudspeaker. Although not illustrated, a cross-over circuit is normally used in conjunction with these types of loudspeakers. As is well known in the art, such a cross-over may be located in front of the amplifier, or be located in the enclosure 102, for separating the electrical signals into two frequency bandwidths and directing signals in respective bandwidths to each set of drivers 124, 126.

Once the electrical signals each the drivers 124, 126 the electrical energy is converted into mechanical energy by the drivers 124, 126, thus producing sound. The sounds or acoustical energy, in the form of an air pressure waves, are then routed from the drivers 124, 126 to the horn 104 and to the listener.

Most important, however, is the design of the loudspeaker 100 of the present invention with respect to this routing process. The sound from the high frequency drivers 124 is first routed to the throat 110 of the horn 104 through the coupling passage 132. It is again noted that this passage 132 is quite small; in fact, this passage 132 is so small in relation to the wavelength of the sound carried that this passage 132 does not exhibit horn behavior on its own. The high frequency sound is routed by this passage 132 to the space between the walls 134, exiting to the throat 110 of the horn 109 through the aperture formed by the tapered portion 136 of the walls 134. The angle of taper of the walls 134 is chosen to match the angle of the walls 116*a,b* of the horn 104, whereby the horn 104 appears to be continuous to the high frequency sound, even though a small discontinuity exists where the low frequency drivers 126 connect to the horn 104.

The sound from the low frequency drivers 126 is likewise routed to the throat 110 of the horn 104 through the coupling passages 138. These passages 138 are each about the size of the passage 132 which carries all of the high frequency sound. It is important that the passages 138 be of a larger size in order that the low frequency sound not be distorted or otherwise colored.

It is also noted that the low frequency drivers 126 are equidistantly spaced apart from one another by only a small distance relative to the wavelength of the sound produced. This small separation distance causes the sound produced by each driver 126 to be combined in a manner in which the apparent point of sound propagation of the two drivers 126 is a point exactly between their centers. In other words, the low frequency drivers 126 are used coaxially. The coaxial design thus causes the sound to emanate from a point source located along the centerline 128 and within the coupling passage 132 through which the high frequency sound is being delivered. Because the apparent source of the high frequency sound is also along the centerline 128, both the high and low frequency sound appears to be emanating from a single point source.

Once the sound reaches the throat 112 from the drivers 124, 126, the walls 114*a,b* and 116*a,b* of the horn 104 act to direct the sound to the listener. It is important that the single horn 104 direct all of the sound from both the high and low frequency drivers 124,126. In this manner, the horn geometry does not change with respect to the sound produced by either set of drivers 124,126. Therefore, directivity of the sound is extremely good, even at the cross-over frequencies. The common horn 104 also ensures that the sound from each driver 124,126 emanates in a manner by which there is an apparent coincident source of the low and high frequency sounds in both the vertical and horizontal planes. This is because the walls 114*a,b*, 116*a,b* of the horn 104 act together to direct all of the sound and because of the fact that the apparent source of all of the sound is a single point. This situation is in contrast to that where the sound is separated, for example, in a horn-in-horn arrangement, the apparent source of the high frequency sound is in front of the apparent source of the low frequency sound. Further, in a line array type speaker, such as that described in U.K. Patent No. 303,837, the apparent source of the high and low frequency sounds is separated by a similar distance, even when the sound channels from the high and low frequency drivers are coupled to a single outlet.

The present design is also advantageous because the lengths of the coupling passages 132, 138 are chosen such that the sources of both the high and low frequency sounds are equidistant from the mouth 112 of the loudspeaker 100. In this manner, the sounds produced by the low and high frequency drivers 124,126 are in phase, eliminating the need for a time-delay circuit.

Figure 7:
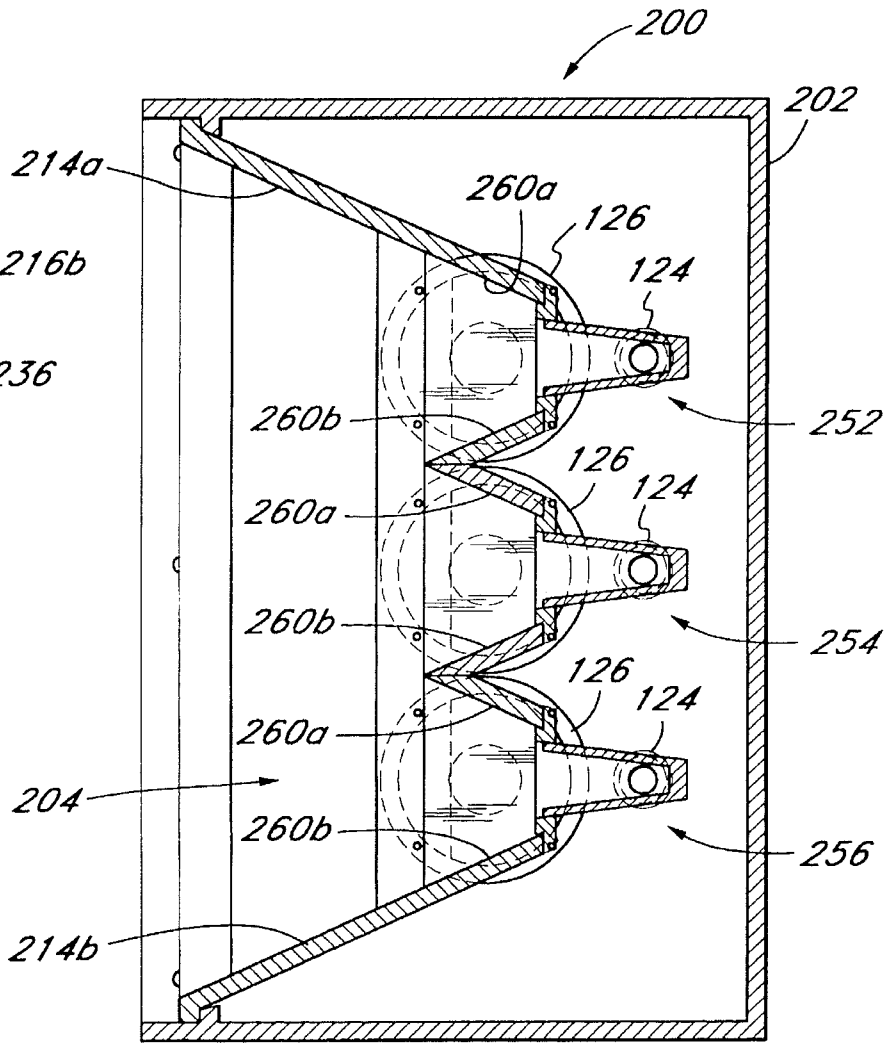
FIG. 7 is a cut-away side view of the loudspeaker of FIG. 6, taken along line 7—7.
Figure 6:
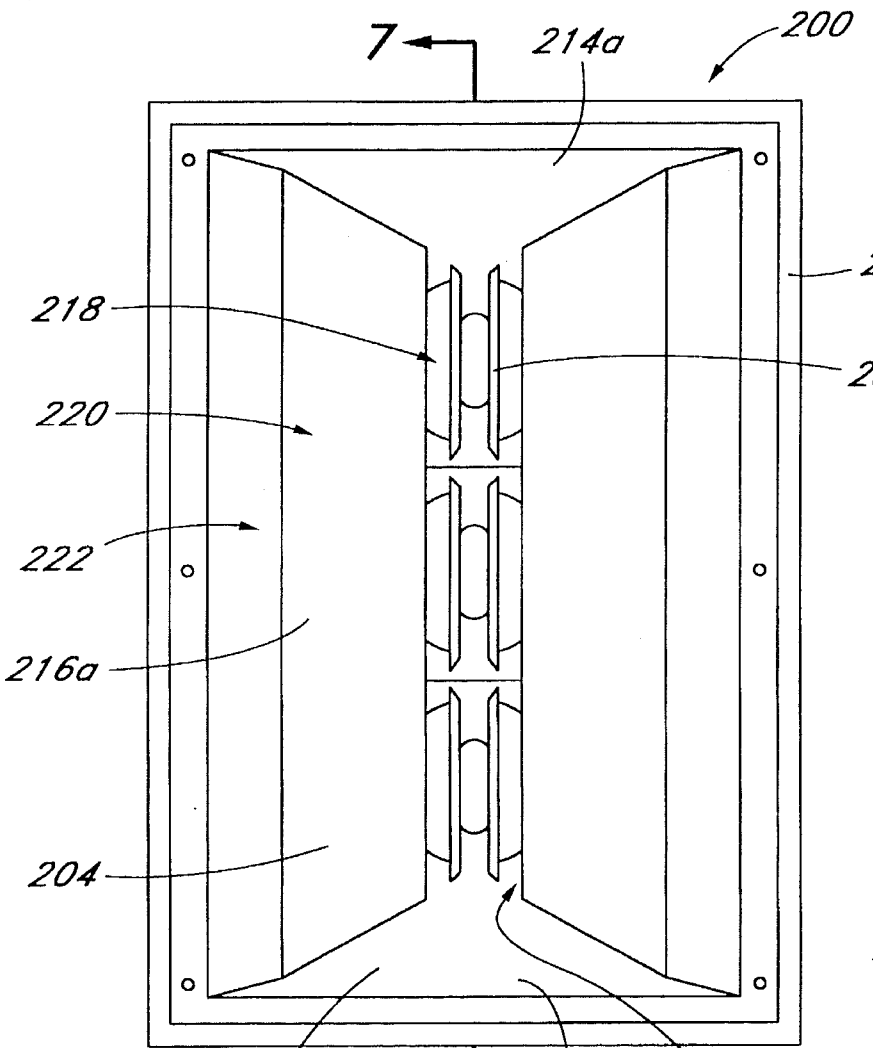
FIG. 6 is a front view of an alternate embodiment speaker of the present invention.

An alternate embodiment of the present invention is illustrated in FIGS. 6 and 7. These figures illustrate a loudspeaker 200 which utilizes a "stacked" driver arrangement.

This loudspeaker 200 preferably comprises an enclosure 202 in which a single horn 204 is located. The horn 204 preferably has a throat area 210 and mouth area 212. Similar to the horn 104 described in conjunction with FIGS. 3–5, the horn 204 preferably comprises top and bottom walls 214*a,b* and side walls 216*a,b*. The top and bottom walls 214*a,b* preferably open an angle of 40 degrees with respect to one another. These side walls 216*a,b* however, are longer along a vertical axis 256 passing through the speaker 200 than in the speaker 100 described above. The side walls 216*a,b* once again preferably form three sections: a first section 218 at the throat 210 in which the walls 216*a,b* are parallel; a second section 220 in which the walls 216*a,b* open with respect to one another by an angle of 60 degrees; and a third section 222 in which the walls 216*a,b* open with respect to one another at a 104-degree angle. The other dimensions of the horn 204 are similar to those described above in conjunction with FIGS. 3–5. Once again, the angles formed by the top and bottom walls 214*a,b* and side walls 216*a,b* and their exact dimensions may be changed depending on the particular directional characteristics desired.

The horn 204 transmits sound generated by three low frequency/high frequency drive units 252, 254, 256. Each of these units 252, 254, 256 is preferably identical to that described above in conjunction with FIGS. 3–5. Each of these units 252, 254, 256 includes a top wall 260*a* and a bottom wall 260*b*, as well as walls 234 therebetween which have a tapered portion 236 and form an aperture. Each of these units 252, 254, 246 is connected to the horn 204 in the throat area 210.

As illustrated, the units 252, 254, 256, are stacked on top of the other. In the case of the top unit 252, the top wall 114*a* of the horn 204 extends directly into the unit 252, merging with the top wall 260*a* of this unit 252. The bottom wall 260*b* of the top unit 252 extends downwardly (preferably at the same angle as the bottom wall 214 of the horn 204) until it meets a top wall 260*a* of the second unit 254 (which preferably extends upwardly at the same angle as the top wall 214*a* of the horn 204). These walls 260*a,b* meet at a distance into the horn 204, the meeting location being approximately even with the beginning of the second section 220 of the side walls 216*a,b* of the horn 204. Similarly, the bottom wall 260*b* of the second or middle unit 254 extends downwardly until it meets the top wall 260*a* of the third or bottom unit 256. Again, this meeting point is approximately even with the beginning of the second section 220 of the side walls 216*a,b* of the horn 204. Lastly, the bottom wall 260*b* of the third unit 256 preferably leads directly into and is part of the bottom wall 114*b* of the horn 204.

It is noted that when more than one of the units is used as described above, it may be necessary to utilize electronic or physical means to insure that the high frequency sound coverage in the vertical direction is not compromised. Therefore, in the embodiment of the loudspeaker 200 described above, it is preferred that the high frequency drivers 224 of the top unit 252 be directed slightly upwards. Thus, the coupling member to which the drivers 224 are attached in the top unit 252 is preferably angled upwardly approximately 10 degrees with respect to the drivers 224 of the center unit 254. Similarly, the high frequency drivers 224 of the bottom unit 256 are preferably directed downwardly through the use of a similar coupling member, this member angling downwardly approximately 10 degrees with respect to the drivers 224 of the center unit 254.

This loudspeaker 200 exhibits the same desirable characteristics as the loudspeaker 100 described above. Preferably, each unit 252, 254, 256 utilizes a multiple-driver approach in which the sound produced by the drivers is routed to a common throat area and through a single horn. As described above in conjunction with loudspeaker 100, the throat area 210 of the horn 204 and the structure which routes the sound produced by the drivers is dimensioned and designed such that these structures do not exhibit horn characteristics by themselves. Instead, the sounds from all three units 252, 254, 256 have a source point located in the throat 210 of the horn 204, and whereby it appears as if all of the sounds are emanating from the single horn 204. In all other aspects, this loudspeaker 200 behaves as the loudspeaker 100 described above, and its operation is so similar that it will not be described again here.

This loudspeaker 200 has the benefit, however, that the output of the speaker 200 is increased proportionally as the number of driver units is increased from one, as described above in conjunction with loudspeaker 100, to three, as described above. It is possible for two or more of these units in conjunction with one another along with a single horn 204 to produce a single loudspeaker having high power capabilities.

Figure 8:
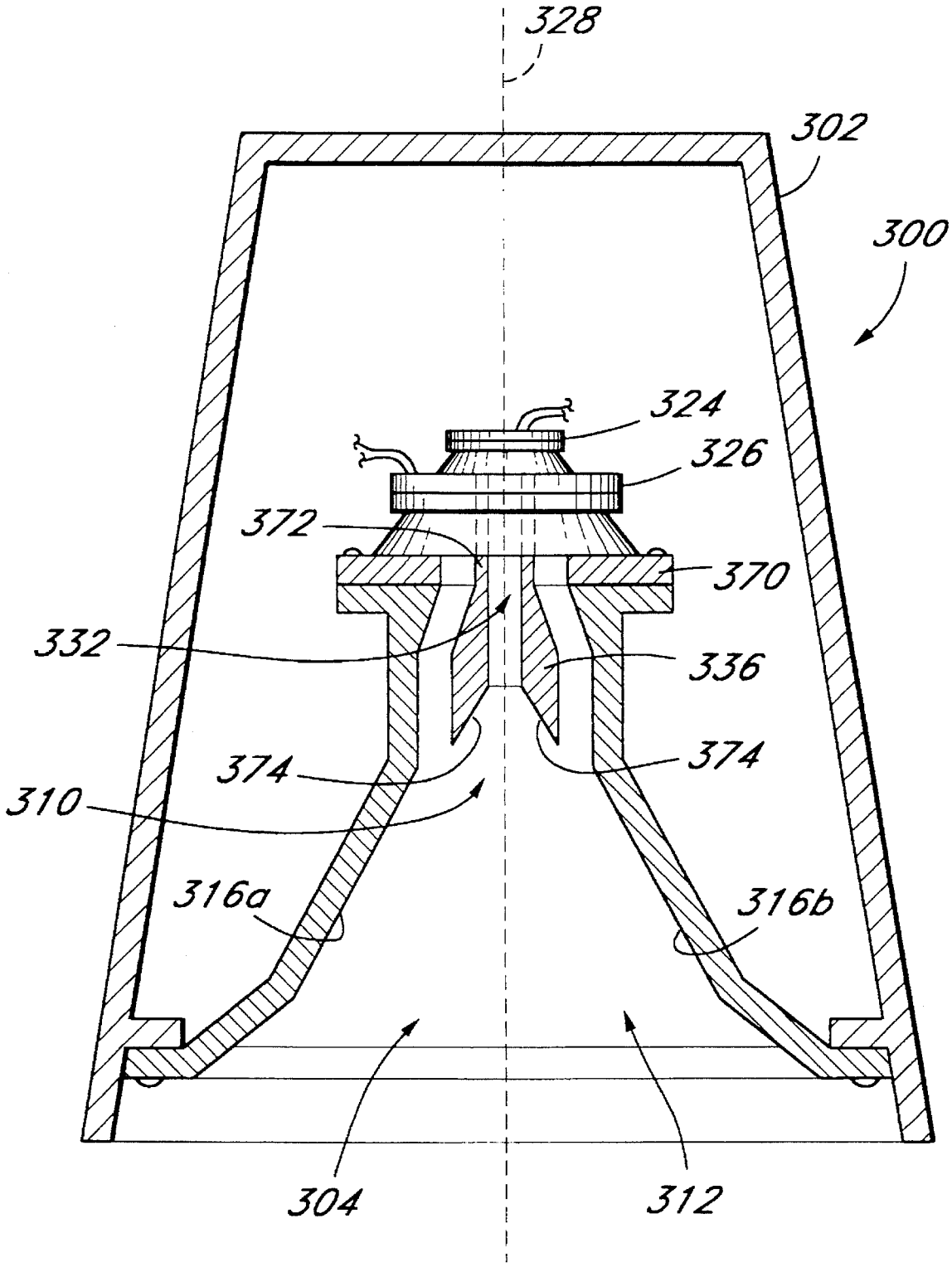
FIG. 8 is a cut-away top view of an alternate embodiment loudspeaker of the present invention.

Referring to FIG. 8, yet another loudspeaker 300 of the present invention is shown. Preferably, this loudspeaker 300 comprises a single horn 304 preferably mounted within an enclosure 302. The horn 304 has a throat area 310 and mouth 312 and preferably has top and bottom walls 314*a,b* and side walls 316*a,b*. Preferably, the horn 304 has the same dimensions and construction as the horn 104 described above in conjunction with FIGS. 3–5.

In this embodiment, however, a single high frequency driver 324 and a single low frequency driver 326 are connected to the throat 310 of the horn 304. As illustrated, the low frequency driver 326 is mounted along a centerline 328 of the loudspeaker 300. The low/frequency driver 326 is connected to the rear of the throat area 310 of the horn 304 by two members 370.

The high frequency driver 324 is located directly behind the low frequency driver 326 and is connected directly to the low frequency driver 326. Preferably, an adapter 372 is attached to the high frequency driver 324 and passes through the center of the low/frequency driver 326 into the throat area 310 of the horn 304. The adapter 372 preferably forms a passage 332 through which the sound generated by the high frequency driver 324 is directed. It is preferred that this passage 332 be similar in shape and have dimensions close to those described for the passage 132 used in the loudspeaker 100 described above. The adapter 372 is preferably thin walled and tubular in shape at its connection with the driver 324. The adapter 372 is connected to two walls 334. These walls 334 are similar to those described in conjunction with FIGS. 3–5, and include a tapered portion 374 located within the throat 310 of the horn 304 (the angle at which the taper is formed preferably being the same as that of the horn), thus forming an aperture area similar to that described above in conjunction with FIGS. 3–5.

Once again, the operation of the loudspeaker 300 is similar to that of the loudspeaker 100 described above. Therefore, it will not be described here.

This loudspeaker 300 has the same desirable characteristics as the loudspeaker 100 described above. In particular, this loudspeaker 300 utilizes the same multiple-driver, single horn approach. Once again, this single horn design causes the high and low frequency sounds to have a single coincident source in both the horizontal and vertical planes, as the high and low frequency sounds merge at the throat area 310 of the horn 304 and all the sound is then transmitted by a single horn 304. Further, the loudspeaker 300 exhibits very good directivity characteristics, as the horn geometry does not change with respect to the high and low frequency sounds produced. Also, there is once again no need for a time delay circuit, as the high and low frequency sounds are produced at a point equidistant from the mouth 312 of the horn 304. This loudspeaker 300 design eliminates the need for a coaxial arrangement of the low frequency drivers 326, since the single driver 326 is located along the centerline 328 of the loudspeaker 300. This means that both the low and high frequency sounds have an apparent coincident source located on the centerline 328, since the high frequency driver 324 is also located on the centerline 328.

Further, this embodiment of the invention is particularly cost effective, as it utilizes only one high and low frequency driver. This loudspeaker 300 is particularly useful in situations in which less power handling capability is necessary.

Although this invention has been described in terms of certain preferred embodiments, other embodiments that are apparent to those of ordinary skill in the art are also within the scope of this invention. Accordingly, the scope of the invention is intended to be defined only by reference to the following claims.

I claim:

1. A multiple-driver, single horn loudspeaker for converting electrical signals into acoustical sound for transmission to a listener, the loudspeaker comprising:

an enclosure having one open end;

at least one high frequency driver mounted within said enclosure to produce high frequency sound;

at least one low frequency driver mounted within said enclosure to produce low frequency sound;

a single horn having a first end coupled to said low frequency driver and having a second end opening at said open end of said enclosure;

a first coupling passage acoustically connecting said high frequency driver to said first end of said horn to communicate said high frequency sound from said high frequency driver to said first end of said horn, said first coupling passage having a first acoustic length, said first coupling passage oriented with respect to said horn such that said high frequency sound exits from said first coupling passage into said first end of said horn, said first coupling passage having a first axis such that said high frequency sound exits from said first coupling passage and enters said first end of said horn propagating in a first direction along said first axis; and a second coupling passage acoustically connecting said low frequency driver to said first end of said horn to communicate low frequency sound from said low frequency driver to said first end of said horn, said second coupling passage oriented with respect to said first end of said horn such that low frequency sound exits from said second coupling passage into said first end of said horn, said second coupling passage having a second axis parallel to said first axis such that low frequency sound exits from said second coupling passage and enters said first end of said horn propagating in said first direction along said second axis, said second coupling passage have a second acoustic length, said second acoustic length being substantially equal to said first acoustic length so that said high frequency sound and said low frequency sound travel substantially the same distance from said high frequency driver and said low frequency driver, respectively, to said first end of said horn such that said high frequency sound and said low frequency sound have an acoustic effect of emanating from a single, common acoustic center, both spatially and temporally.

2. The loudspeaker of claim 1, wherein said first coupling passage has a maximum width spacing of less than the minimum wavelength of the sound being transmitted.

3. A multiple-driver, single horn loudspeaker for converting electrical signals into acoustical sound for transmission to a listener, the loudspeaker comprising:

an enclosure having a centerline;

a first pair of drivers for producing low frequency sounds mounted equidistantly on either side of said centerline;

a second pair of drivers for producing high frequency sounds mounted equidistantly on either side of said centerline;

a single horn having a first end and a second end, said single horn acoustically connected to both pairs of drivers at said first end;

first coupling passages having a first acoustic length and acoustically connecting said first pair of drivers to said first end of said horn, said first coupling passages coupling low frequency sound from said first pair of drivers to said first end of said horn, said first coupling passages having respective parallel first axes oriented with respect to said horn such that said low frequency sound enters said first end of said horn propagating in a first direction along said first axes; and second coupling passages having a second acoustic length and acoustically connecting said second pair of drivers to said first end of said horn, said second coupling passages coupling high frequency sound from said second pair of drivers to said first end of said horn, said second coupling passages having respective second axes in parallel with said first axes, said second axes oriented with respect to said horn such that said high frequency sound enters said first end of said horn propagating in said first direction along said second axes, wherein said first acoustic length and said second acoustic length are chosen so that said high frequency sounds and said low frequency sounds have an acoustic effect of emanating from a single, common acoustic center, both spatially and temporally.

4. The loudspeaker of claim 3, wherein said horn includes a mouth at one end and a throat at the other, said drivers being connected to the throat of the horn.

5. A multiple-driver, single horn loudspeaker for converting electrical signals into acoustical sound for transmission to a listener, the loudspeaker comprising:

an enclosure having a centerline therethrough;

a pair of low frequency drivers for producing low frequency sound mounted one on either side of said centerline and equidistant from said centerline;

a pair of high frequency drivers for producing high frequency sound mounted one on either side of said centerline;

a single horn having a throat at one end and a mouth at an other end for transmission of sound to a listener;

a first coupling passage having a first acoustic length and located along said centerline acoustically connecting said high frequency drivers to the throat of said horn, said first coupling passage propagating high frequency sound from said high frequency drivers to said throat of said horn, said first coupling passage having a first axis oriented such that said high frequency sound exits said first coupling passage into said throat of said horn propagating in a first direction along said first axis; and second and third coupling passages each having a second acoustic length and acoustically connecting said low frequency drivers to the throat of said horn, said second and third coupling passages located on either side of said first coupling passage, said second and third coupling passages propagating low frequency sound from said low frequency drivers to said throat of said horn, said second and third coupling passages having respective second and third axes, said second and third axes oriented in parallel with said first axis and oriented such that said low frequency sound exits said second and third coupling passages into said throat of said horn propagating in said first direction along said second and third axes, wherein said first and second acoustic lengths are chosen so that said sound emanating from both said high frequency drivers and said low frequency drivers have an acoustic effect of emanating from a single, common acoustic center, both spatially and temporally.

6. The loudspeaker of claim 5, wherein said first coupling passage has a maximum width spacing of less than the minimum wavelength of the sound being transmitted.

7. The loudspeaker of claim 5, wherein said first coupling passage includes an aperture where it enters the throat of the horn.

8. The loudspeaker of claim 7, wherein said aperture opens at an angle approximately the same as the horn.

9. The loudspeaker of claim 7, wherein said horn includes a portion which opens at approximately the same angle as said aperture.

10. The loudspeaker of claim 5, wherein said horn has a passage connecting said throat and said mouth.

11. The loudspeaker of claim 10, wherein said passage has a first section which opens at about a 60-degree angle in the horizontal plane and a second portion which opens at about a 104-degree angle in the horizontal plane.

12. The loudspeaker of claim 5, wherein said horn opens at an angle of about 40 degrees in the vertical plane.

13. A multiple-driver, single horn loudspeaker for converting electrical signals into acoustical sound for transmission to a listener, the loudspeaker comprising:

at least one low frequency driver for producing sounds having a first range of low frequencies;

at least one high frequency driver for producing sounds having a second range of high frequencies, said second range of high frequencies partially overlapping said first range of low frequencies; and a single horn, having a first end and a second end, said first end acoustically connected to said drivers, said single horn transmitting said low and high frequency sounds from said first end to said second end and to a listener, said low frequency driver and said high frequency driver acoustically coupled to said first end of said single horn via first and second acoustic passages, said first and second acoustic passages having respective first and second parallel axes such that sound from said low frequency driver and said high frequency driver enters said first end of said horn propagating along said first and second axes in substantially a same direction, said first and second acoustic passages having lengths selected such that said horn has a single spatial acoustical center in both the horizontal and vertical planes for said high and low frequency sounds.

14. The loudspeaker of claim 13, wherein said low frequency and said high frequency driver are situated so that the sounds produced by said drivers are temporally in phase.

15. The loudspeaker of claim 14, wherein the acoustical center is located along a centerline of the horn.

16. A multiple-driver, single horn loudspeaker for converting electrical signals into acoustical sound for transmission to a listener, the loudspeaker comprising:

a single horn having a first end and a second end;

at least one low frequency driver for producing low frequency sounds;

at least one high frequency driver for producing high frequency sounds; and coupling passages acoustically connected from said drivers to said first end of said horn for transmitting said sounds from said drivers to said first end of said horn and then to said listener, said coupling passages having lengths selected to provide substantially identical propagation path lengths from said low frequency driver and from said high frequency driver to said first end of said horn, said coupling passages having respective parallel axes oriented with respect to each other and with respect to said first end of said horn such that sounds from said drivers enter said horn propagating in a common direction along said axes, thereby creating a coincident spatial and temporal apparent sound source from either driver in both the horizontal and vertical planes.

17. A multiple-driver, single horn loudspeaker having a centerline, the loudspeaker for converting electrical signals into acoustical sound for transmission to a listener, the loudspeaker comprising:

a horn having a throat at a first end and a mouth at a second end for transmission of sound to a listener;

a single high frequency driver located along said centerline;

a first coupling passage acoustically connecting said high frequency driver to said throat of said horn at said first end, said first coupling passage having a first axis coincident with said centerline, said first coupling passage oriented with respect to said throat such that sound from said high frequency driver enters said throat at said first end propagating in a first direction along said first axis; and a single low frequency driver mounted in front of said high-frequency driver and located along said centerline and acoustically connected to said throat of said horn at said first end by a second coupling passage having a second axis parallel to said first axis, said low frequency driver positioned with respect to said horn and coupled to said horn such that sound from said low frequency driver enters said throat of said horn at said first end propagating in said first direction along said second axis, said high and low frequency drivers aimed forwardly in said first direction and sharing a single common spatial and temporal acoustic center, where said first direction is the direction in which said mouth of said horn faces.

18. The loudspeaker of claim 17, wherein said first coupling passage includes an adapter connected to said high frequency driver.

19. The loudspeaker of claim 17, wherein said coupling passage passes from said high frequency driver through said low frequency driver to said throat.

20. A multiple-driver, single horn loudspeaker for converting electrical signals into acoustical sound for transmission to a listener, the loudspeaker comprising:

a single horn having a throat at a first end and a mouth at a second end for transmission of sound to a listener; and a number of sound producing units acoustically connected to said throat at said first end by passages, each of said sound producing units having a centerline and comprising at least one high frequency driver and at least one low frequency driver positioned proximate to said centerline, the length of said passages chosen so that each of said sound producing units has a spatially and temporally-coincident source of sound in the horizontal and vertical planes, each of said passages having a respective axis, said axes oriented in parallel with each other and oriented with respect to said horn such that sound from said sound producing units propagate through said passages and enter said throat at said first end of said horn propagating in a common direction along said axes.

21. The loudspeaker of claim 20, wherein said units are stacked vertically upon one another.

22. The loudspeaker of claim 20, wherein said high and low frequency drivers are mounted on said centerline of said units.

23. The loudspeaker of claim 20, including a single said high frequency driver mounted on said centerline and including two low frequency drivers, said low frequency drivers mounted equidistantly on either side of said centerline.

24. A multiple-driver, single horn loudspeaker for converting electrical signals into acoustical sound for transmission to a listener, the loudspeaker comprising:

an enclosure having a centerline;

a single horn having a first end and a second end;

a pair of low frequency drivers for producing low frequency sounds mounted equidistantly on either side of said centerline and acoustically connected to said horn at said first end by first and second passages, said first and second passages having respective first and second axes in parallel with each other, said first and second passages oriented with respect to said horn such that low frequency sounds enter said horn at said first end propagating in a first direction along said first and second axes; and at least one high frequency driver for producing high frequency sounds mounted on said centerline and acoustically connected to said first end of said horn by a third passage having a third axis, said third axis in parallel with said first and second axes, said high frequency driver having an acoustic center, said high frequency sounds propagating in said first direction from said acoustic center, wherein each of said first and second passages has a length chosen so that said pair of low frequency drivers has an apparent acoustic center coincident with said acoustic center of said high frequency driver, both spatially and temporally.

* * * * *